US008262081B2

(12) United States Patent
Ford et al.

(10) Patent No.: US 8,262,081 B2
(45) Date of Patent: Sep. 11, 2012

(54) TRAIL EDGE GUIDE DEFLECTOR FOR IMPROVED MEDIA FEEDING

(75) Inventors: Brian R. Ford, Walworth, NY (US); Kenneth E. Giunta, Penfield, NY (US); Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 38 days.

(21) Appl. No.: 12/881,332

(22) Filed: Sep. 14, 2010

(65) Prior Publication Data

US 2012/0061910 A1 Mar. 15, 2012

(51) Int. Cl.
*B65H 3/54* (2006.01)

(52) U.S. Cl. ..... 271/104; 271/171; 271/98; 271/170

(58) Field of Classification Search ..... 271/171, 271/145, 104, 170, 97, 98, 90, 123
See application file for complete search history.

(56) References Cited

U.S. PATENT DOCUMENTS 7,290,764 B2 11/2007 Marasco
7,540,489 B2 * 6/2009 Kushida ..... 271/98

FOREIGN PATENT DOCUMENTS

JP 2000203737 A * 7/2000
JP 2006008260 A * 1/2006

* cited by examiner

*Primary Examiner* — Luis A Gonzalez
(74) *Attorney, Agent, or Firm* — Simpson & Simpson, PLLC

(57) ABSTRACT

An apparatus for a media feeding system having a trail edge guide, a frame, an elevator, a feed head and a stack of media including a plurality of sheets of media disposed on the elevator, wherein the plurality of sheets of media include an uppermost set of sheets of media located at a top portion of the stack of media. The apparatus includes a trail edge deflector having a body including an angularly disposed lower surface, at least one opening, and at least one stopping surface. The angularly disposed lower surface being shaped to contact and thereby shingle the uppermost set of sheets of media, the at least one opening being shaped for complimentary sliding engagement with the trail edge guide thereby permitting the trail edge deflector to slide along a portion of the trail edge guide and the at least one stopping surface being shaped to limit downward sliding movement of the trail edge deflector along the trail edge guide.

16 Claims, 10 Drawing Sheets

TRAIL EDGE GUIDE DEFLECTOR FOR IMPROVED MEDIA FEEDING

INCORPORATION BY REFERENCE

The following patent is incorporated herein by reference in its entirety: U.S. Pat. No. 7,290,764, issued on Nov. 6, 2007.

TECHNICAL FIELD

The presently disclosed embodiments are directed to providing a device that prevents mis-feeding and multi-feeding of sheet media within a printing system, and more particularly to providing a trail edge guide deflector adapted to align the top portion of a stack of sheet media within a printing system.

BACKGROUND

Printing systems, such as high demand printing systems, consume large volumes of paper. When paper trays are loaded or filled in a feeder system attached to a printing system or other media handling system, the stacks of media are often loaded in an unregistered state. As an operator loads each successive grouping of media, e.g., a ream of paper, alignment offsets are created in the stack that can lead to feed problems due to shifts in the top sheet process position, i.e., the uppermost sheets of media. FIG. 1 broadly depicts feeder system 10 comprising elevator tray 12, trail edge guide 14 and feed head 16. As is well known in the art, feed head 16 may take various forms, for example, a vacuum feed head or a friction feed head. During media loading, some reams of media are disposed closer to the trail edge position or in other words trail edge guide 14, i.e., reams 18*a* and 18*b*, while other reams of media are disposed closer to the feeding position or in other words feed head 16, i.e., reams 20*a* and 20*b*. Due to the offset of the position of top sheet 22 relative to feed head 16, top sheet 22 may not enter the printing system (not shown) in its predicted manner thereby entering later than expected or in a skewed orientation, for example. Such a condition is commonly referred to as a mis-feed.

Moreover, the weight of media stacked in a feeder system subjects the trail edge guides to forces that often deflect the guide from its typical vertical orientation. Such deflection causes the top sheet lead edge/process feed location to be altered, which in turn leads to increased feeder shutdowns, i.e., mis-feeds and/or multi-feeds. FIG. 2 broadly depicts feeder system 10 comprising elevator tray 12, trail edge guide 14 and feed head 16. Again, during loading, some reams of media are disposed closer to the trail edge position, i.e., reams 24*a* and 24*b*, while other reams of media are disposed closer to the feeding position, i.e., reams 26*a* and 26*b*. In this example, it can be see that the lateral force imparted by ream 24*a* on guide 14 changes the position of guide 14, i.e., deflects guide 14 from it typical vertical position by angle $\alpha$. Such deflection further amplifies the aforementioned stacking alignment issues. Thus, as elevator tray 12 lifts the reams of media, the unregistered alignment of the various reams of media can cause top sheet 28, located at the top sheet process position, to be so misaligned relative to the sheets below that feed head 16 not only feeds top sheet 28 but also simultaneously feeds the sheet or sheets just below top sheet 28. Under such conditions, a vacuum port (discussed in greater detail infra) of feed head 16 is exposed to the sheet or sheets below top sheet 28, thereby drawn up more sheets than just top sheet 28. Such a condition is commonly referred to as a multi-feed. Additionally, it should be appreciated that deflection of the trail edge guide can lead to interferences with parts of the feeder system, such as a frame or feeder tray during loading and unloading operations.

A variety of devices have been utilized to prevent the foregoing failure modes. For example, complex spring loaded "pushers" have been placed in the trail edge region and arranged to apply a lateral force against a plurality of sheets of media thereby forming an aligned stack of media. Although these devices may temporarily align the media relative to each other, upon application of air flow from a "fluffer", described in greater detail infra, the previously aligned sheets may become misaligned. For example, air directed opposite the process direction is sometimes introduced near the feed head to aid in the separation of sheets for purposes of proper feeding. As air is introduced opposite the process direction, sheets may be pushed back away from the feed head, thereby further compounding the issue of misalignment between the top sheet and the sheets below. This condition may also push the top sheet back so far that it fails to load at the proper time, thereby resulting in a mis-feed.

The present disclosure addresses an apparatus for ensuring that media in the top sheet process position is aligned in such a way as to prevent the occurrence of mis-feeds and multi-feeds thereby maximizing printing system performance and throughput.

SUMMARY

The present embodiments use an angled or sloped trail edge guide deflector which maintains a position at the top trail edge of a media stack. The angled guide may be set at a variety of angles, e.g., 20, 30, 45 or 50 degrees, or in the alternative, at least 20 degrees, at least 30 degrees, or at least 40 degrees (See angle $\beta$ in FIG. 6B). The angled guide or deflector translates vertical gravitational force into a consistent trail edge process force to ensure proper leading edge placement of the top sheets of media relative to the feed head. The angled deflector front face, also considered an angled lower surface, maintains contact with the top trail edge of the media stack independent of the trail edge guide perpendicularity, i.e., offset or angular misalignment of the trail edge guide. If the trail edge guide is greater than 90 degrees or is offset up to 10 millimeters at its top, the sloped trail edge deflector continues to maintain contact at a similar angle and provides the correct process force to the top sheets needed for consistent feeding. The deflector includes a low profile and incorporates a bearing surface for sliding on the vertical trail edge guide thereby ensuring low cost and functionality within a limited space, in particular for large media sizes in the tray, e.g., trays capable of feeding media of 26 inches in length or greater.

According to aspects illustrated herein, there is provided an apparatus for a media feeding system having a trail edge guide, a frame, an elevator, a feed head and a stack of media including a plurality of sheets of media disposed on the elevator, wherein the plurality of sheets of media include an uppermost set of sheets of media located at a top portion of the stack of media. The apparatus includes a trail edge deflector having a body including an angularly disposed lower surface, at least one opening, and at least one stopping surface. The angularly disposed lower surface being shaped to contact and thereby shingle the uppermost set of sheets of media, the at least one opening being shaped for complimentary sliding engagement with the trail edge guide thereby permitting the trail edge deflector to slide along a portion of the trail edge guide and the at least one stopping surface being shaped to limit downward sliding movement of the trail edge deflector along the trail edge guide.

According to other aspects illustrated herein, there is provided a media feeding system including a trail edge guide, an elevator, a stack of media disposed on the elevator and including a plurality of sheets of media having an uppermost set of sheets of media located at a top portion of the stack of media and a trail edge deflector including a body having an angularly disposed lower surface, at least one opening, and at least one stopping surface. The angularly disposed lower surface being shaped to contact and shingle the uppermost set of sheets of media, the at least one opening being shaped for complimentary sliding engagement with the trail edge guide thereby permitting the trail edge deflector to slide along a portion of the trail edge guide and the at least one stopping surface being shaped to limit downward sliding movement of the trail edge deflector along the trail edge guide.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
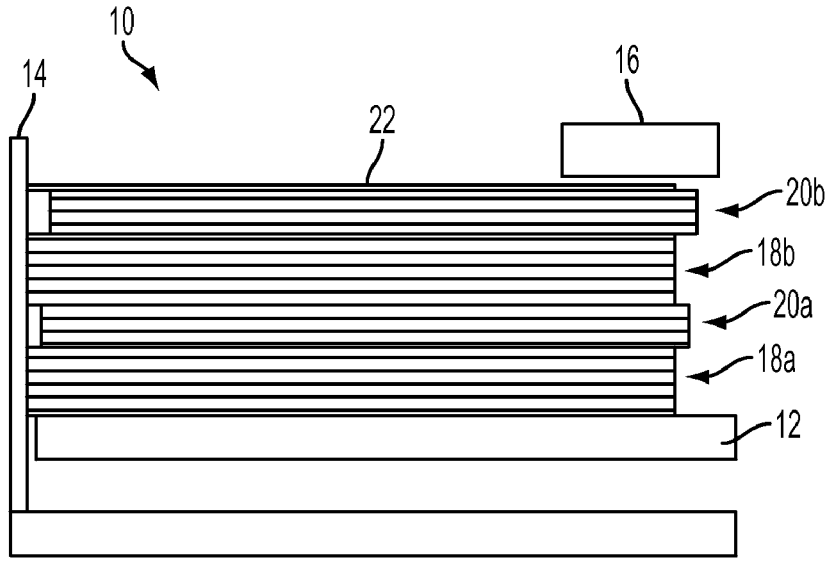
FIG. 1 PRIOR ART
FIG. 1 is a side elevational view of a prior art feeder system.

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "mis-feed" is intended to be broadly construed as any media feeding failure wherein either no sheet is fed or a single sheet is fed in such a fashion that it is outside of printing system tolerances, e.g., starting edge location, skew, etc., while "multi-feed" is intended to mean any media feeding failure wherein more than one sheet is simultaneously fed into the printing system. Additionally, as used herein, "sheet," "sheet of paper," "paper," "media" and "print media" refer to, for example, paper, transparencies, parchment, film, fabric, plastic, photo-finishing papers or other coated or non-coated substrate media in the form of a web upon which information or markings can be visualized and/or reproduced.

Furthermore, as used herein, "media handling system" is intended to mean a system which shifts, moves or manipulates media from one location to another, e.g., a media stack to a printing system. Moreover, the words "printer," "printer system", "printing system", "printer device" and "printing device" as used herein encompasses any apparatus, such as a digital copier, digital printer, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. "Trail edge position" is intended to mean the edge of media furthest from the feed head or in other words closest to the trail edge guide, while "feeding position" and "process position" are intended to mean the edge of media closest to the feed head. Additionally, "process direction" is intended to mean the direction in which media is fed into the printing system. Furthermore, "shingling" is intended to mean positioning discreet sheets of media so that each subsequent sheet is offset in the process direction from the sheet immediately below.

Moreover, although any methods, devices or materials similar or equivalent to those described herein can be used in the practice or testing of these embodiments, some embodiments of methods, devices, and materials are now described.

The foregoing embodiments may be used in combination with printing and duplicating devices such as laser printers, xerographic devices, etc. Moreover, these embodiments may be used in any device which utilizes a sheet feeding system. Such embodiments are not intended to be limited by the following disclosure, which embodiments are only limited by the appended claims.

In vacuum corrugated feeder systems, it is necessary to maintain accurate lead/process edge positioning for proper feeding, i.e., limiting the chance of multi-feeds and misfeeds. It should be appreciated that in such systems, a vacuum feed head draws the top sheet up away from the sheets below, thereby permitting a single sheet to be fed into the printing system.

Figure 2:
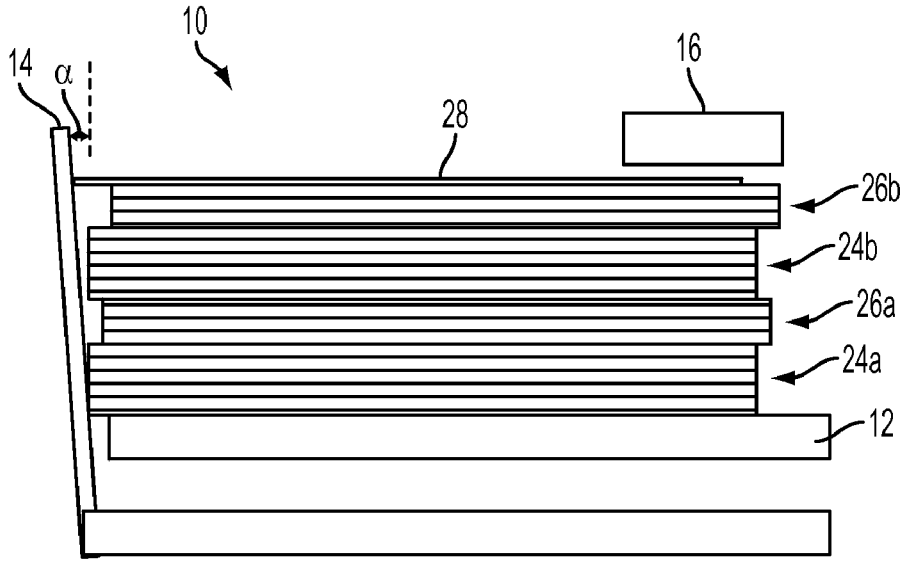
FIG. 2 PRIOR ART
FIG. 2 is a side elevational view of another prior art feeder system.

As described above, in high capacity feed trays, the feed stacks are made up of multiple reams of paper. During the loading of the tray, these reams often are not properly registered, i.e., aligned, and the weight associated with the entire stack can easily overcome the trail edge guide used to support the stack at the trailing edge. (See FIGS. 1 and 2). When this happens the trail edge guide is moved away from the top of the stack as the guide leans away from the stack, i.e., greater than 90 degrees, or is offset by a lower ream which is registered further back than the upper most ream.

Even if the operator attempts to move the trail edge guide back up to the stack, it is typically not possible to move the entire stack to register with the guide. For example, the paper stacks in some printing system feeder trays weigh approximately 175 pounds and cannot be moved once they are in a loaded position.

Figure 3:
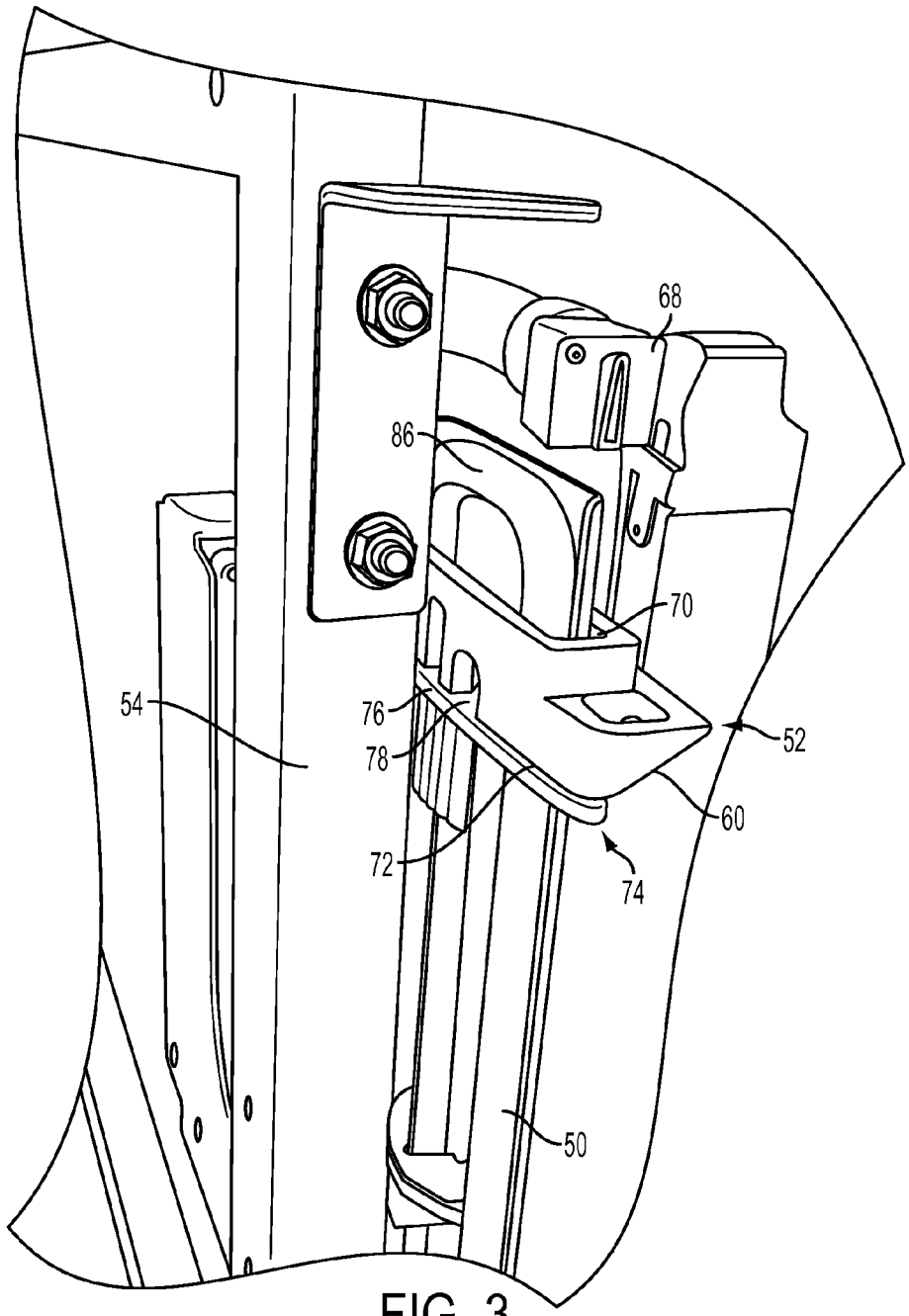
FIG. 3 is a partial perspective view of a present embodiment deflector mounted on a trail edge guide.
Figure 4:
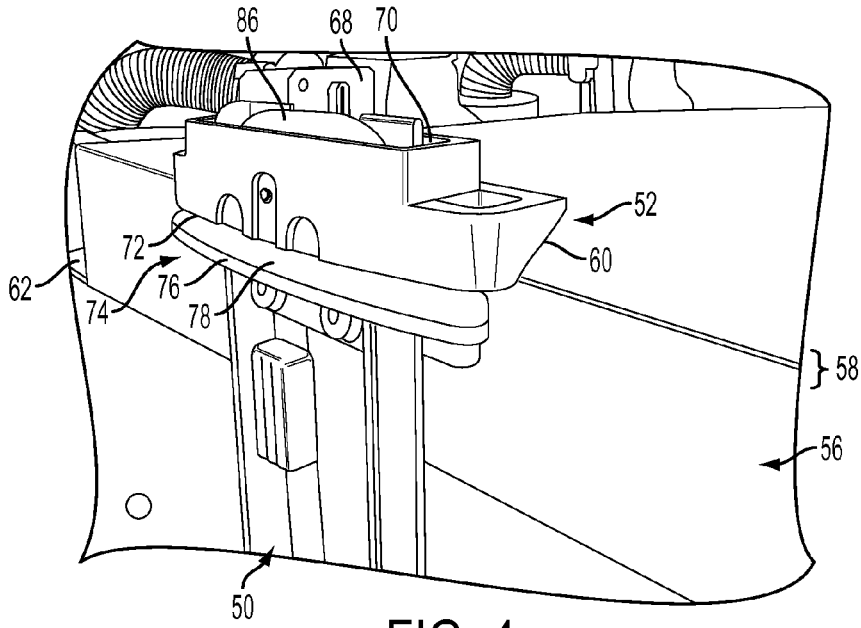
FIG. 4 is another partial perspective view of a present embodiment deflector mounted on a trail edge guide having a media stack raised into contact with the deflector.
Figure 5:
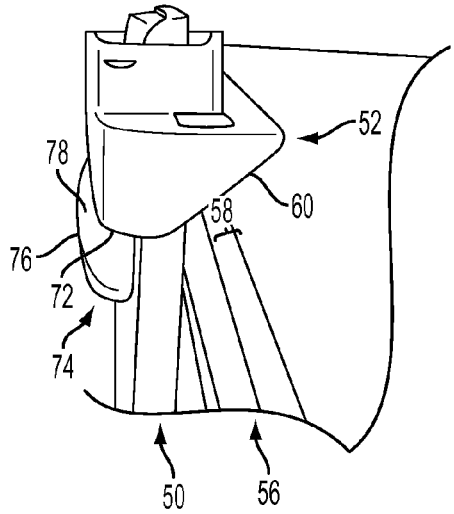
FIG. 5 is yet another partial perspective view of a present embodiment deflector mounted on a trail edge guide having a media stack raised into contact with the deflector.

This becomes even more important with larger length media where the trail edge guide must maintain a small cross section to maximize sheet length tray capacity while minimizing overall system size or accommodating existing space constraints of the current system, e.g., when opening and closing the tray the trail edge guide can interfere with the frame when very large sheets are loaded. FIG. 3 shows trail edge guide 50 having an embodiment of sliding trail edge deflector 52 disposed thereon. As can be clearly seen in the figure, when the feeding system is loaded with large sheet media, i.e., trail edge guide 50 is positioned furthest from the feed head, there exists a small space between deflector 52 and feeding system frame 54. Thus it should be appreciated that spatial constraints, i.e., the distance between deflector 52 and frame 54, can be overcome by the present embodiments.

The present embodiments broadly comprise sliding deflector 52 which rides vertically on trail edge guide 50. By using vertical gravitational force, deflector 52 provides a constant lateral force on the top or uppermost sheets of stack 56, i.e., top sheets 58. This is accomplished through the use of angularly disposed lower surface 60 of deflector 52 which allows deflector 52 to follow the top of stack 56 as stack 56 is raised into the feeding position by elevator tray 62, i.e., is raised upwardly toward feed head 64. Sliding defector 52 is self-located and the combination of the shape of lower surface 60 and the constant lateral force provides a consistent level of controlled shingling and process direction force to the top sheets, i.e., force applied in the direction of unidirectional arrow 66. Mis-feeds and multi-feeds often occur when the top sheets of media float on the air from fluffers 68 and air knifes (not shown) to the trail edge guide thereby exposing the lead edge vacuum holes in feed head 64. Such air flow is commonly introduced to create a separation between sheets of media to facilitate movement of one sheet relative to another, without frictional engagement therebetween. This then can cause arching of the media and can further cause the feeder to acquire two or more sheets simultaneously. This condition is commonly known as a multi-feed, which occurs during the shuttle feed operation. Thus, the consistency of the controlled trail edge position provided by the present embodiment sliding deflector allows for improved feeding with a reduction in mis-feeds and multi-feeds.

It should be appreciated that lower surface 60 of sliding deflector 52 starts behind trail edge guide 50 which ensures the uppermost sheets of stack 56, i.e., top sheets 58, always contacts lower surface 60. Furthermore, trail edge deflector 52 includes opening 70 adapted for complimentary sliding engagement with trail edge guide 50, and also includes at least one stopping surface 72. Stopping surface 72 is adapted to limit downward sliding movement of the trail edge deflector along the trail edge guide. In view of the foregoing, it should be appreciated that lower surface 60 extends beyond opening 70 in the direction opposite the process direction, i.e., extends beyond trail edge guide 50.

The present apparatus may further includes frame deflector 74. Frame deflector 74 comprises at least one generally arcuate edge 76 and stop surface 78. Frame deflector 74 is adapted to be secured to trail edge guide 50 by any known means in the art, e.g., screws or nuts and bolts. Arcuate edge 76 is adapted to prevent trail edge deflector 52 from contacting frame 54 when trail edge guide 50 and elevator 62, i.e., the media stack handling subassembly, are moved to a loading position. In other words, as the media stack handling subassembly is moved from a location within frame 54 to a location outside of frame 54, frame deflector 74 protects trail edge guide deflector 52 from contacting frame 54. Thus, arcuate edge 76 protrudes from trail edge guide 50 by a greater distance than trail edge deflector 52 protrudes from trail edge guide 50. Moreover, stop surface 78 is adapted to contact the at least one stopping surface of trail edge deflector 52, e.g., stopping surface 72, thereby limiting downward movement of trail edge deflector 52 along trail edge guide 50.

Frame deflector 74 may further include mounting flange 80 arranged substantially perpendicular relative to stop surface 78. Mounting flange 80 is adapted to secure frame deflector 74 to trail edge guide 50. In the embodiments shown in the figures, mounting flange 80 includes holes 82 which are arranged to receive a fastening device, e.g., a screw or bolt, therethrough, thereby fixedly securing frame deflector 74 to trail edge guide 50. It should be appreciated that other securing means are also contemplated, e.g., tabbed protrusions arranged to engage complimentary holes on trail edge guide 50, and such variations are within the spirit and scope of the claims.

Trail edge deflector 52 may further include features which increase its respective functionality. For example, trail edge deflector may include locking tab 84 arranged to limit upward movement of trail edge deflector 52 along trail edge guide 50. In other words, as trail edge deflector 52 moves upwardly along trail edge guide 50, locking tab 84 hinders the removal of trail edge deflector 52 by interfering with member 86 of trail edge guide 50. Although trail edge deflector 52 may be removed from trail edge guide 50, significant upward force must be applied in order to accomplish the same.

Trail edge deflector 52 may be at least partially formed of a material having a sufficient dry lubricity to permit shingling of uppermost sheets of media 58 as elevator 62 raises stack of media 56 during operation. It should be appreciated that "at least partially formed" is intended to mean that all of trail edge deflector 52, or a portion of trail edge deflector 52, e.g., lower surface 60, may be formed from an appropriate material, while "sufficient dry lubricity" is intended to mean a lubricity level such that as uppermost sheets of media 58 are upwardly pressed against lower surface 60, sheets of media 58 naturally form a shingling arrangement as sheets of media 58 slide relative to lower surface 60 (See FIG. 6B). Such materials may include but are not limited to acrylonitrile butadiene styrene (ABS), polyoxymethylene (DELRIN®), a fluoropolymer, and combinations thereof. Fluoropolymers may include but are not limited to polytetrafluoroethylene, polyvinylfluroide, polyvinylidene fluoride, polychlorotrifluoroethylene, perfluoroalkoxy polymer, fluorinated ethylene-propylene, polyethylenetetrafluoroethylene, polyethylenechlorotrifluoroethylene and perfluoropolyether.

Figure 6A:
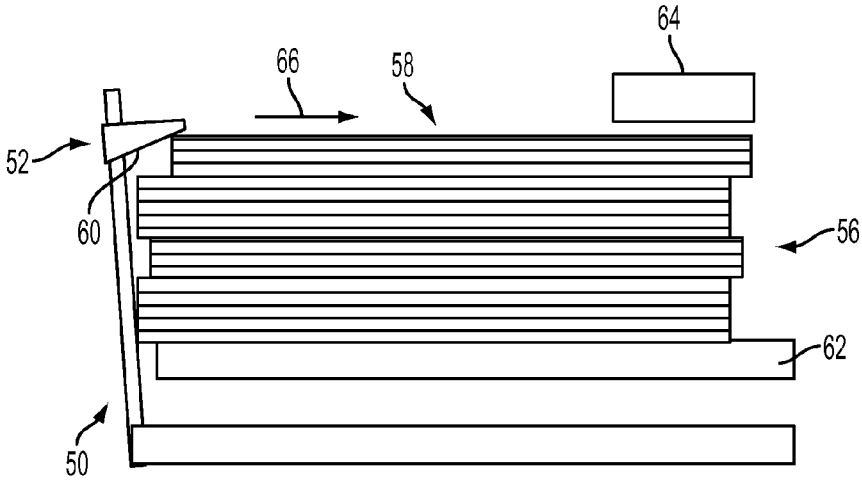
FIG. 6A is a side elevational view of a feeder system having a present embodiment deflector arranged therein.

It should be appreciated that the combination of the present embodiments of the sliding trail edge deflector's vertical motion along the trail edge guide and its angled lower surface overcomes the effects of the lower sheets or set of sheets which deflect the trail edge guide away from the top of the stack (See FIG. 6A). It should be further appreciated that in any spring loaded or pivoting guide design, the media stack condition below the top sheets can negatively impact how a pivoting guide contacts the top sheets and therefore how the guide controls the top sheets. The present embodiments, as described herein, obviate such negative impacts.

Figure 6B:
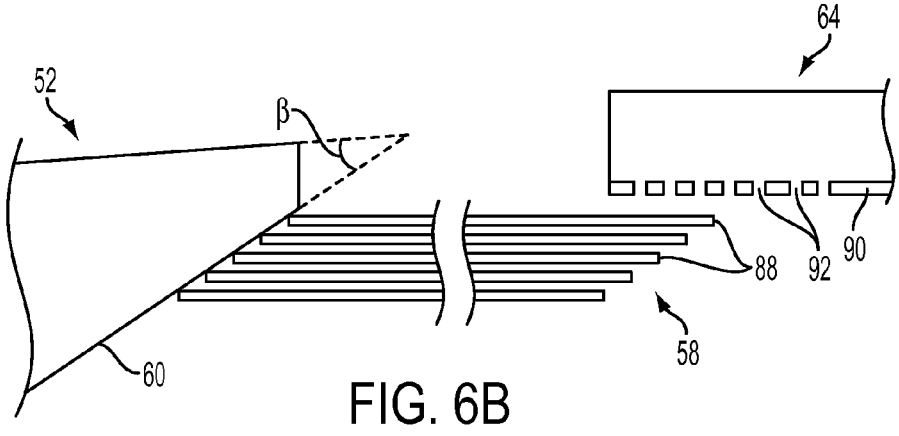
FIG. 6B is an enlarged side elevational view showing a present embodiment deflector in contact with the top of a media stack at the trail edge position and a feed head proximate the top of the media stack at the process location.
Figure 7A:
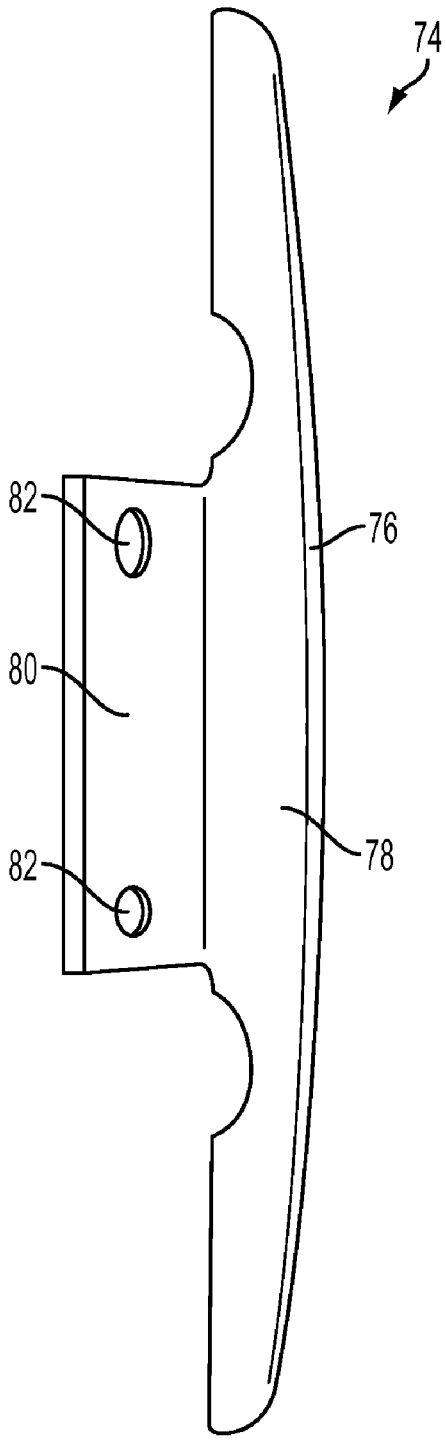
FIG. 7A is a top-front perspective view of a present embodiment combination frame deflector and stop.
Figure 7B:
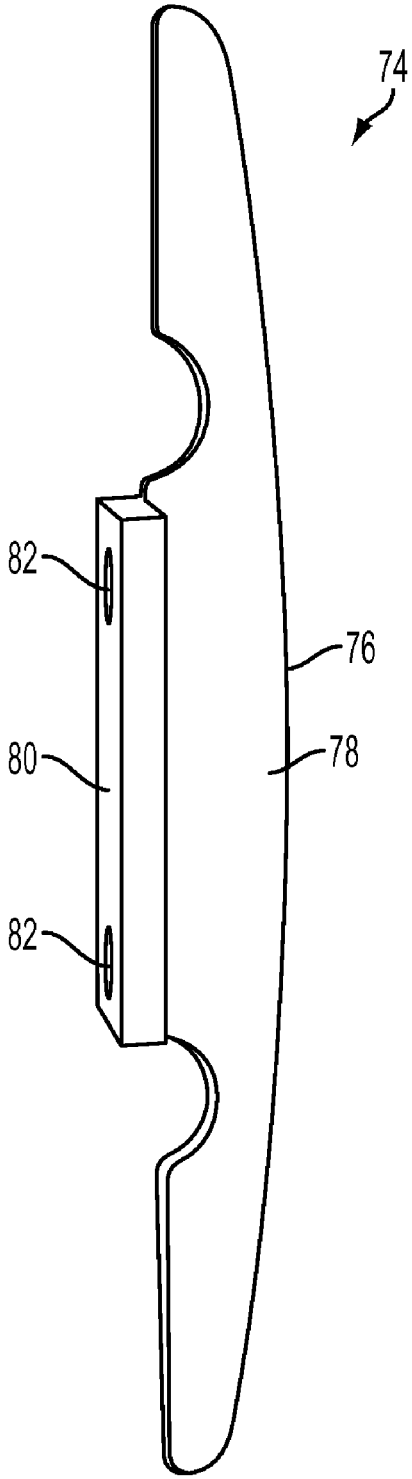
FIG. 7B is a top-back perspective view of a present embodiment combination frame deflector and stop.
Figure 8A:
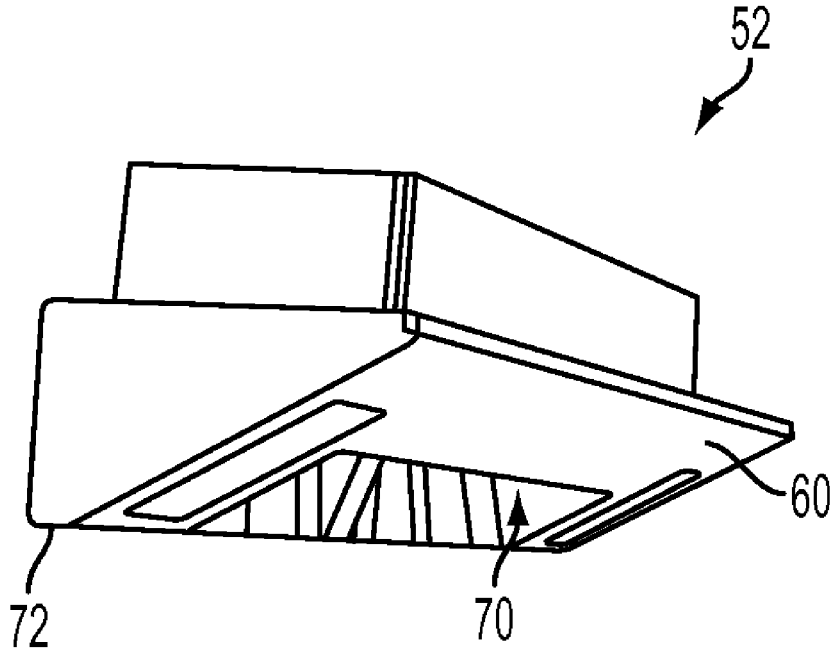
FIG. 8A is a side perspective view of a present embodiment trail edge guide deflector.
Figure 8B:
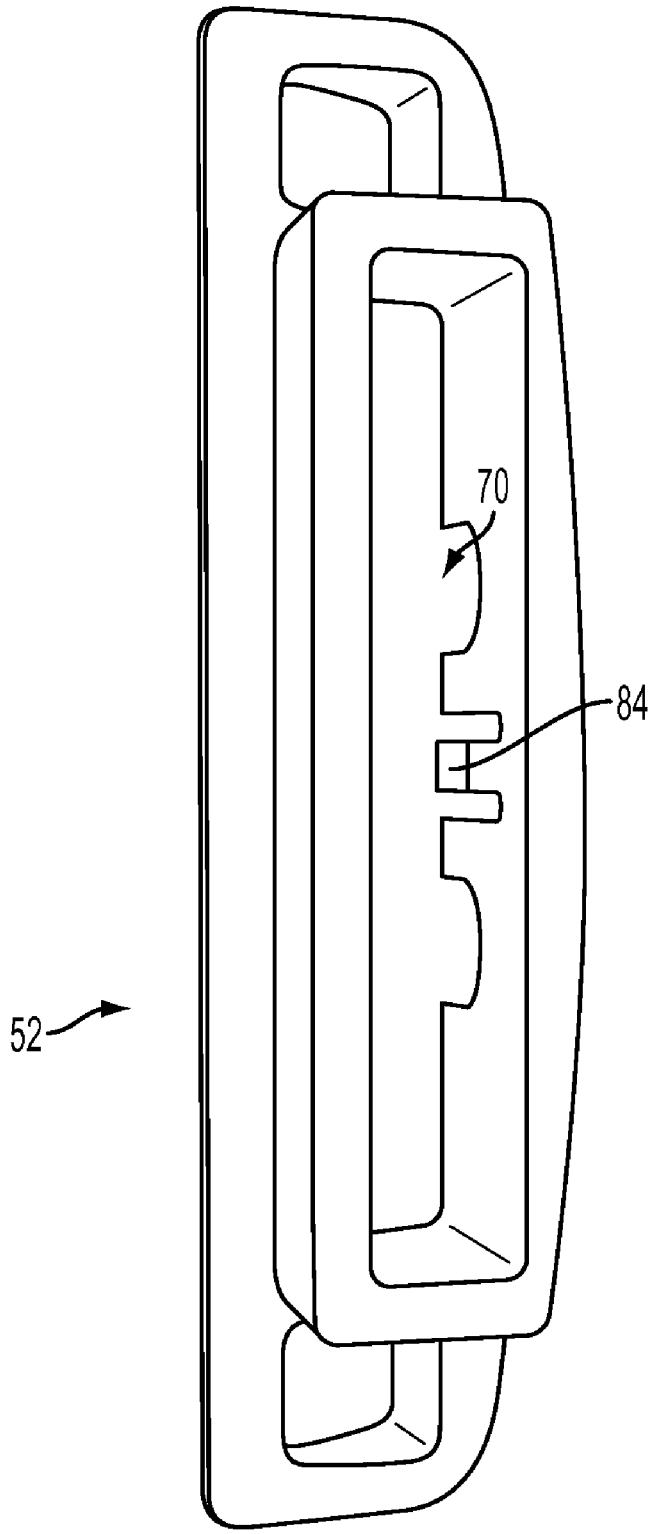
FIG. 8B is a top perspective view of a present embodiment trail edge guide deflector.
Figure 8C:
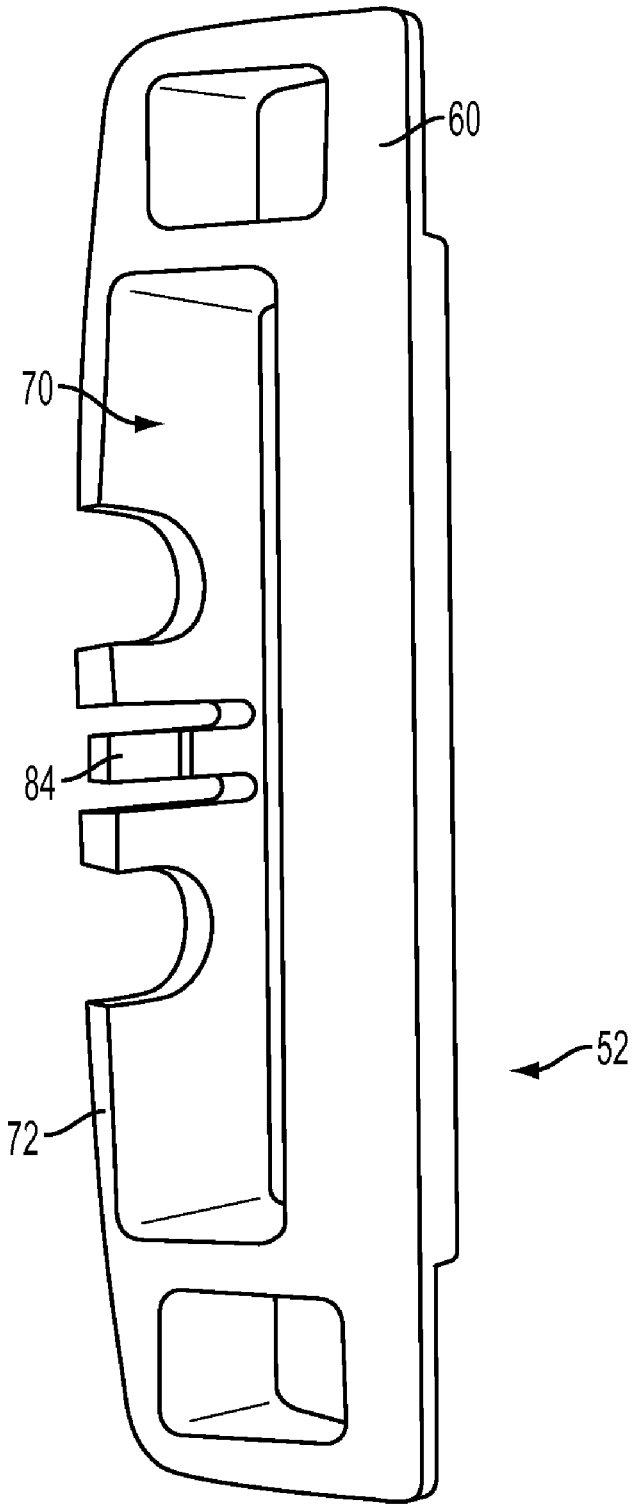
FIG. 8C is a bottom perspective view of a present embodiment trail edge guide deflector; and, FIG. 9 is a bottom perspective view of a vacuum plate for a feed head.
Figure 9:
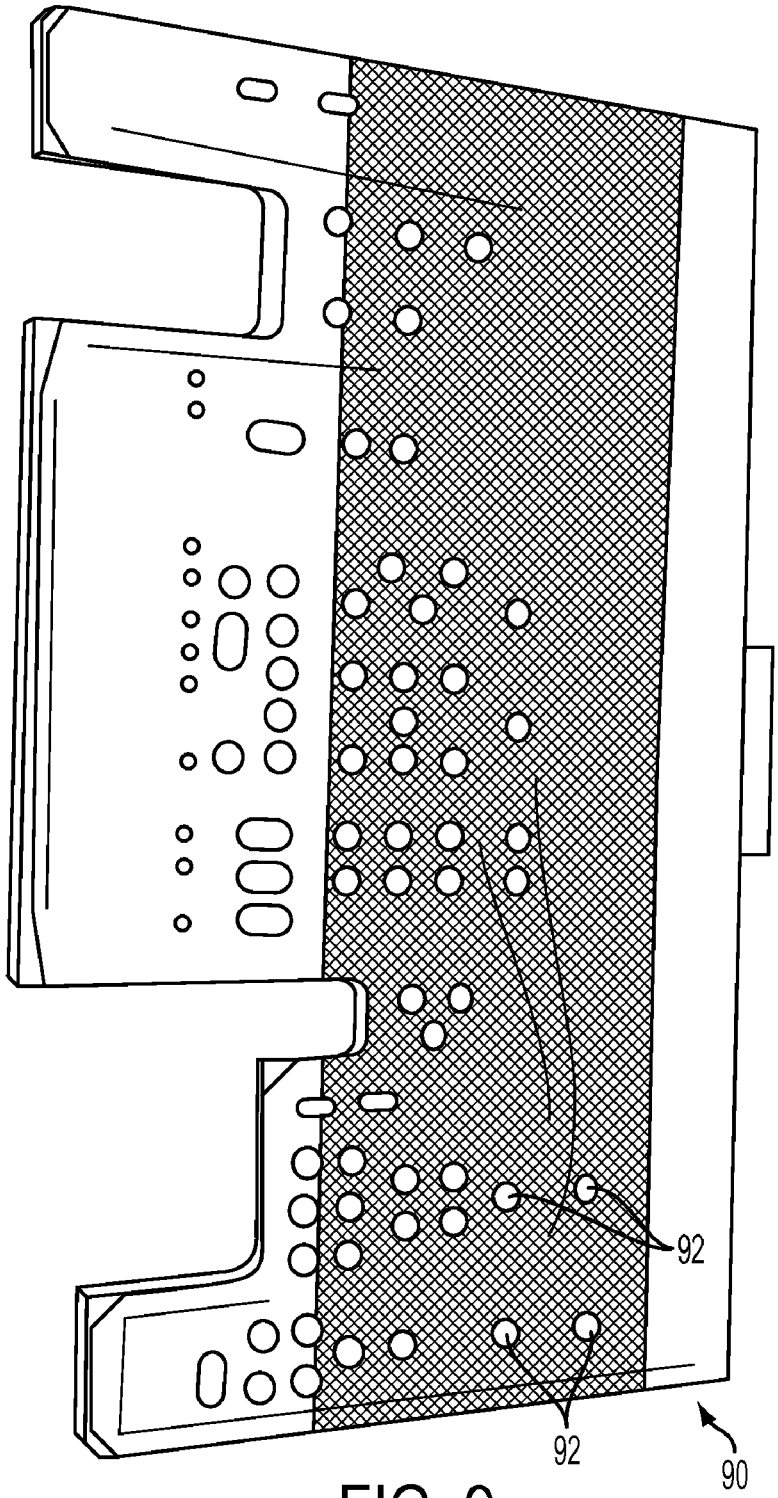

Due to the free-floating nature of trail guide deflector 52 in combination with lower surface 60, the present embodiments provide consistent deflector placement, consistent process direction force, and the control needed for top feed vacuum corrugation feeding and other top feeding systems. Such embodiments allow for over 10 mm of process media stack mis-registration, while maintaining acceptable levels of system performance. As shown in FIG. 6B, the shingling caused by trail edge deflector 52 arranges uppermost sheets 58 in such a way that each sheet 88 is slightly offset towards feed head 64 relative to the next sheet 88 immediately below, i.e., offset in the process direction. Thus, as feed head 64 draws air through vacuum plate 90 via vacuum ports or holes 92, only sheet 88 located at the top of uppermost sheets 58 is captured by feed head 64. In other words, multi-feeds are prevented because only a single sheet is captured. It should be appreciated that if more than one sheet of uppermost sheets 58 were exposed to holes 92, then more than one sheet would be simultaneously captured by feed head 64 thereby resulting in a multi-feed failure condition. One of ordinary skill in the art will recognize that there is effectively an acquisition window within which the top sheet alone must lie in order for proper function of the feeding system.

It should be further appreciated that the present embodiments permit the consistent feeding of 26 inch wide sheet media. However, the present embodiments are not limited to 26 inch media and may be used in any system having trail edge guide control adapted for optimal feeding performance. The present embodiments may be retrofit into existing feeding systems thereby increasing their usefulness while decreasing the overall impact on system cost.

It should be yet further appreciated that in view of the foregoing, the present embodiments include a trail edge deflector that automatically adjusts to the trail edge stack contour. The trail edge deflector incorporates a pre-determined angle to transform vertical gravitational force and associated motion into controlled horizontal registration relative to a feed head. The present trail edge deflector translates vertically along the trail edge guide thereby maintaining a consistent position at the top of the feed stack to improve top sheet feeding. The foregoing accommodates for media stack mis-registration and/or trail edge guide positioning errors, while preventing mis-feeding and multi-feeding of sheet media. Thus, the present embodiments provide a pre-shingling guide that displaces the top sheets forward relative to the feed head prior to feeding.

The present embodiments reduce mis-feeds and multi-feeds due to better lead edge placement of media at the vacuum corrugation feed-head. Moreover, the present embodiments provide pre-shingle functionality for improved top feed of sheets for vacuum corrugation feeders and friction retard feeders. The present embodiments may be produced for a low cost, while providing high reliability due to a minimum number of parts, e.g., no springs, motors, or complicated mechanisms. Still further, the present embodiments provide consistent trail edge contact even with poorly stacked media and with non vertical trail edge guides, and are unaffected by media type and media condition, e.g., light weight, heavy weight, coated or uncoated stock. The present embodiments can accommodate trail edge guides that vary from vertical due to deformation or tolerance buildup, and reduce design space requirements allowing for a smaller footprint and large sheet length capacity. Moreover, the present embodiments are arranged to accommodate dynamic tilt used in high end media feeding systems.

In summary, the present embodiments comprise a small molded or manufactured deflector added to the top of the trail edge guide which can 'float' vertically within a controlled distance and angled toward the feed head. As the stack of media is raised to the feeding position, sheets are forced forward towards the feed head in a shingled fashion. The compliant nature of the trail edge deflector positions paper correctly against the feed head for reliable media handling. Regardless of the trail edge guide deflection, as the media stack elevates, the lower surface face angle overcomes the horizontal displacement of the deflection, assuming a low sheet to sheet frictional component. The vertical 'float' along with the angled surface provides a simple spring force to move the top sheets into position. For systems utilizing an 'airbed' feeding process, friction is eliminated sheet to sheet in order to ensure that the force of the trail edge guide deflector provides the required force to position the top sheet relative to the feeder.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An apparatus for a media feeding system comprising a trail edge guide, a frame, an elevator, a feed head and a stack of media comprising a plurality of sheets of media disposed on the elevator, wherein the plurality of sheets of media comprise an uppermost set of sheets of media located at a top portion of the stack of media, the apparatus comprising:

a trail edge deflector comprising a body having an angularly disposed lower surface, at least one opening, and at least one stopping surface, wherein the angularly disposed lower surface being shaped to contact and thereby shingle the uppermost set of sheets of media, the at least one opening being shaped for complimentary sliding engagement with the trail edge guide thereby permitting the trail edge deflector to slide along a portion of the trail edge guide and the at least one stopping surface being shaped to limit downward sliding movement of the trail edge deflector along the trail edge guide the apparatus further comprising at least one of the following:

the trail edge deflector further comprising a locking tab arranged to limit upward movement of the trail edge deflector along the trail edge guide; and, a frame deflector having at least one generally arcuate edge and a stop surface, the frame deflector being securable to the trail edge guide, wherein the at least one generally arcuate edge being shaped to preclude the trail edge deflector from contacting the frame when the trail edge guide and elevator are moved to a loading position, and wherein the stop surface being shaped to contact the at least one stopping surface of the trail edge deflector thereby limiting downward movement of the trail edge deflector along the trail edge guide.

2. The apparatus of claim 1 wherein the frame deflector further comprises a mounting flange arranged substantially perpendicular relative to the stop surface and being securable the frame deflector to the trail edge guide.

3. The apparatus of claim 1 wherein the trail edge deflector is at least partially formed of a material having a sufficient dry lubricity to permit shingling of the uppermost set of sheets of media as the elevator raises the stack of media.

4. The apparatus of claim 3 wherein the material is selected from the group consisting of: an acrylonitrile butadiene styrene (ABS), a polyoxymethylene, a fluoropolymer and combinations thereof.

5. The apparatus of claim 1 the angularly disposed lower surface comprises an incline angle of at least twenty degrees.

6. The apparatus of claim 1 the angularly disposed lower surface comprises an incline angle of at least thirty degrees.

7. The apparatus of claim 1 the angularly disposed lower surface comprises an incline angle of at least forty degrees.

8. The apparatus of claim 1 wherein the angularly disposed lower surface comprises an incline angle being shaped to cause a top sheet of the plurality of sheets of media to be positioned further from the trail edge guide than a sheet immediately below the top sheet thereby causing the feed head to obtain only the top sheet.

9. A media feeding system comprising:

a trail edge guide;

an elevator;

a stack of media disposed on the elevator and comprising a plurality of sheets of media having an uppermost set of sheets of media located at a top portion of the stack of media; and, a trail edge deflector comprising a body having an angularly disposed lower surface, at least one opening, and at least one stopping surface, wherein the angularly disposed lower surface being shaped to contact and shingle the uppermost set of sheets of media, the at least one opening being shaped for complimentary sliding engagement with the trail edge guide thereby permitting the trail edge deflector to slide along a portion of the trail edge guide and the at least one stopping surface being shaped to limit downward sliding movement of the trail edge deflector along the trail edge guide the system further comprising at least one of the following:

the trail edge deflector further comprising a locking tab arranged to limit upward movement of the trail edge deflector along the trail edge guide; and, a frame and a frame deflector having at least one generally arcuate edge and a stop surface, the frame deflector being securable to the trail edge guide, wherein the at least one generally arcuate edge being shaped to preclude the trail edge deflector from contacting the frame when the trail edge guide and elevator are moved to a loading position, and wherein the stop surface being shaped to contact the at least one stopping surface of the trail edge deflector thereby limiting downward movement of the trail edge deflector along the trail edge guide.

10. The media feeding system of claim 9 wherein the frame deflector further comprises a mounting flange arranged substantially perpendicular relative to the stop surface and being securable the frame deflector to the trail edge guide.

11. The media feeding system of claim 9 wherein the trail edge deflector is formed of a material having a sufficient dry lubricity to permit shingling of the uppermost set of sheets of media as the elevator raises the stack of media.

12. The media feeding system of claim 11 wherein the material is selected from the group consisting of: an acrylonitrile butadiene styrene (ABS), a polyoxymethylene, a fluoropolymer and combinations thereof.

13. The media feeding system of claim 9 the angularly disposed lower surface comprises an incline angle of at least twenty degrees.

14. The media feeding system of claim 9 the angularly disposed lower surface comprises an incline angle of at least thirty degrees.

15. The media feeding system of claim 9 the angularly disposed lower surface comprises an incline angle of at least forty degrees.

16. The media feeding system of claim 9 further comprising a feed head, wherein the angularly disposed lower surface comprises an incline angle being shaped to cause a top sheet of the plurality of sheets of media to be positioned further from the trail edge guide than a sheet immediately below the top sheet thereby causing the feed head to obtain only the top sheet.

* * * * *